US005445791A

United States Patent [19]

Gagné

[11] Patent Number: 5,445,791

[45] Date of Patent: Aug. 29, 1995

[54] ALLOY FOR AFTER-FABRICATION HOT-DIP GALVANIZING

[75] Inventor: Martin Gagné, Westmount, Canada

[73] Assignee: Noranda, Inc., Toronto, Canada

[21] Appl. No.: 220,143

[22] Filed: Mar. 30, 1994

[30] Foreign Application Priority Data

Jun. 4, 1993 [CA] Canada ..... 2097784

[51] Int. Cl.[6] ..... C22C 18/00

[52] U.S. Cl. ..... 420/514; 420/513; 427/433; 428/659

[58] Field of Search ..... 420/514, 513; 427/433; 428/659

[56] References Cited

U.S. PATENT DOCUMENTS 4,029,478 6/1977 Lee ..... 428/659
4,389,463 6/1983 Smeggil et al. ..... 428/659
4,636,354 1/1987 Caillerie et al. ..... 420/514
5,082,622 1/1992 Meeus et al. ..... 420/514
5,096,666 3/1992 Farnsworth et al. ..... 420/514

FOREIGN PATENT DOCUMENTS 6177257 4/1986 Japan ..... 420/514
2070050 3/1990 Japan ..... 428/659

OTHER PUBLICATIONS

Hugues, *J. Iron and Steel Institute*, 1950, 166, 77–84.
"General Galvanizing Practice" published by the Galvanizers Association, London, UK, pp. 33–34.

*Primary Examiner*—Deborah Yee
*Attorney, Agent, or Firm*—Keck, Mahin & Cate

[57] ABSTRACT

An alloy for after-fabrication hot-dip galvanizing containing mainly Zn to which is added Bi up to the solubility limit to improve drainage of the Zn alloy.

3 Claims, 2 Drawing Sheets

Effect of Bi on Weight Gain and Coating Thickness (With Pb Additions)

ALLOY FOR AFTER-FABRICATION HOT-DIP GALVANIZING

This invention relates to an alloy to provide improved drainage and a more uniform coating during after-fabrication hot-dip galvanizing.

BACKGROUND OF THE INVENTION

After-fabrication hot-dip galvanizing involves dipping ferrous articles in a bath of molten zinc (Zn). Upon removal of the article from the bath the excess Zn runs off of the article back into the bath. The drainage of the Zn plays a critical role in the surface finish of the galvanized article. Poor drainage will cause Zn to accumulate in angles and corners of the article. Zn will also accumulate in holes, grooves and channels present on the article to be galvanized. Poor drainage is also characterised by icicles which form on edges as the article is removed from the galvanizing bath.

Zinc used for after-fabrication hot-dip galvanizing is saturated in iron (Fe) (~300 ppm). Small amounts of aluminum (Al) (~20 to 70 ppm) are sometimes added to increase the brightness of the coating. Presently the drainage of Zn used for after-fabrication hot-dip galvanizing is increased through the addition of lead (Pb) up to the solubility limit at the galvanizing temperature being used (~1.4 wt % Pb at 460° C.). These levels of Al, Fe and Pb describe a conventional Pb-containing Zn alloy used for after-fabrication hot-dip galvanizing.

STATEMENT OF INVENTION

Applicant has found that the addition of bismuth (Bi), up to the solubility limit (~4 wt % at 460° C.), to a conventional Pb-containing after-fabrication hot-dip galvanizing Zn alloy, described above, will improve the drainage of the Zn and provide a more uniform coating than that obtained with the conventional Pb-containing galvanizing alloy alone.

Similarily, the addition of Bi, up to the solubility limit (~4 wt % at 460° C.), will improve the drainage of Pb-free Zn over that obtained with a conventional Pb-containing galvanizing alloy.

The improvement in drainage results in less Zn being removed with the galvanized article, thinner coatings, while still respecting the standards required for coating thickness, and less Zn accumulated in channels present on the article.

BRIEF DESCRIPTION OF THE DRAWINGS

The invention will now be disclosed, by way of example, with reference to the accompanying drawings in which.

DETAILED DESCRIPTION OF THE INVENTION

Two types of samples, a sheet metal sample and a bolted assembly, were used to evaluate the effect of Bi on the drainage of Zn. The weight gain on each sample was measured, along with the coating thickness on the sheet metal sample. The results of these evaluations were compared to those for samples galvanized in a conventional 1 wt % Pb-containing after-fabrication hot-dip galvanizing alloy.

Figure 1:
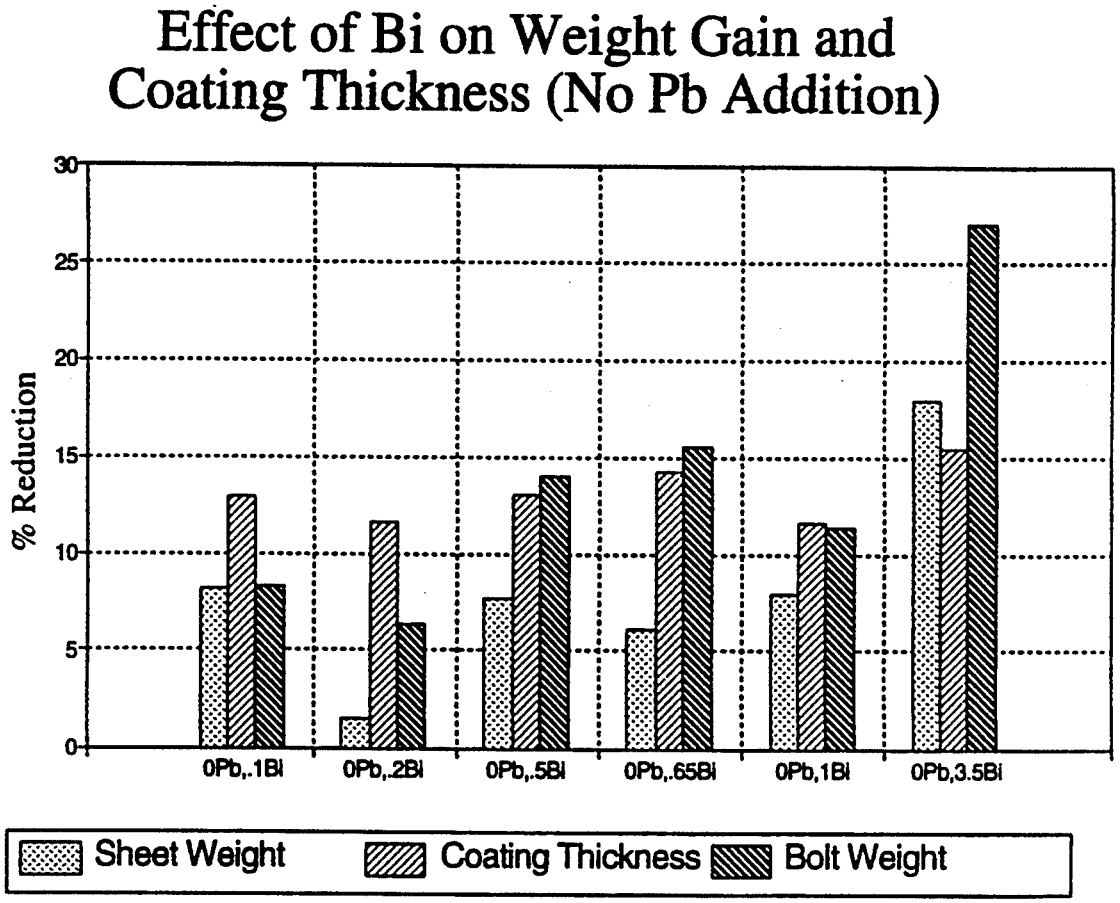
FIG. 1 shows the improvement over galvanizing in a conventional Pb-containing alloy for samples galvanized in a Bi/Zn alloy.
Figure 2:
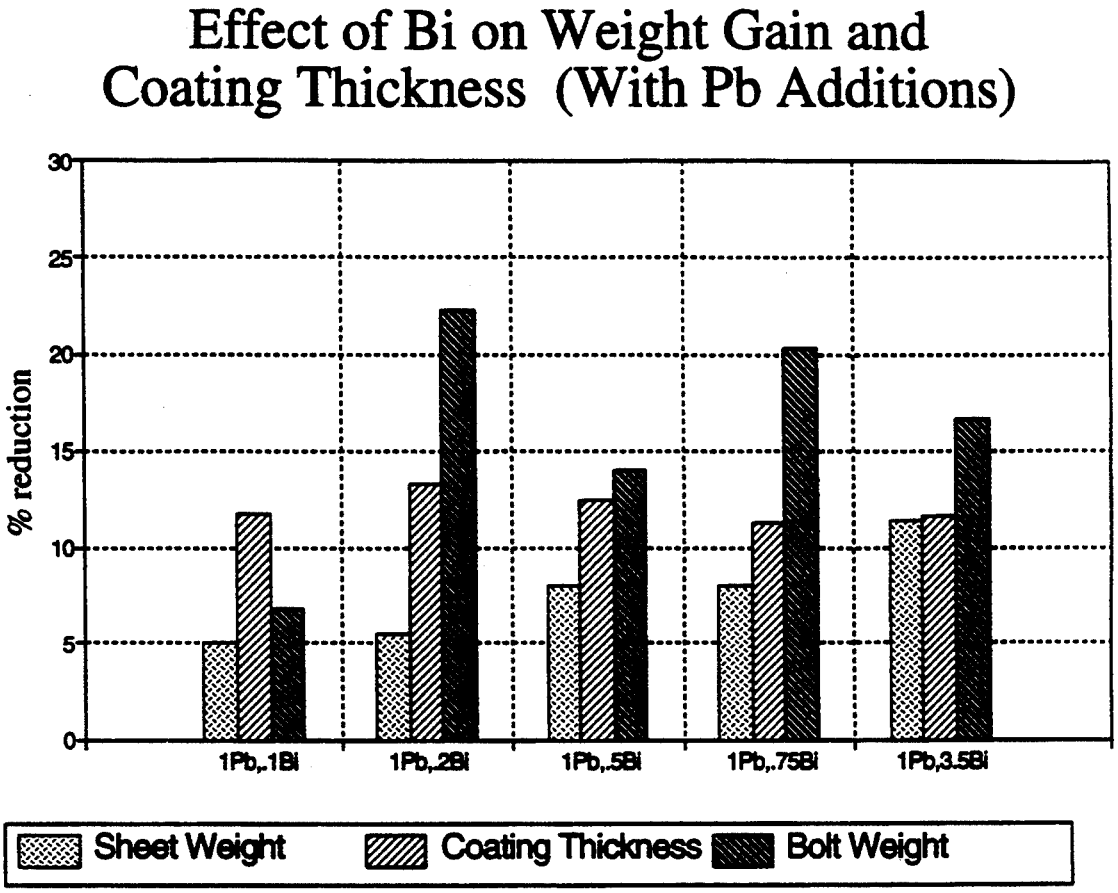
FIG. 2 shows the improvement over galvanizing in a conventional Pb-containing alloy for samples galvanized in a Bi/Zn/Pb alloy.

FIG. 1 shows the improvement over a conventional Pb-containing Zn alloy, obtained by adding 0.1, 0.2, 0.5, 0.65, 1,0 and 3.5 wt % Bi, respectively, to the Zn bath, for the two measured parameters. The improvement is reflected by a reduction in zinc pick-up and coating thickness. FIG. 2 shows the improvement over a conventional Pb-containing Zn alloy, obtained by adding 1 wt % Pb in addition to 0.1, 0.2, 0.5, 0.75 and 3.5 wt % Bi to the Zn bath, for the two measured parameters. The improvement is reflected by a reduction in zinc pick-up and coating thickness. Although at low concentrations higher improvements were obtained using a combination of Pb and Bi, it is seen that substantial improvements were obtained using Bi without Pb additions.

I claim:

1. A zinc alloy for after-fabrication hot-dip galvanizing consisting of effective amounts of bismuth and aluminum to improve drainage of the zinc alloy, wherein the concentration of bismuth is not more than 4 wt % and the concentration of aluminum is 20 to 70 ppm, and the concentration of lead is not more than 1.4 wt %, and a balance of zinc.

2. A ferrous metal article having on the surface thereof a hot-dip coating consisting of the alloy according to claim 1.

3. A method for after-fabrication hot-dip galvanizing of ferrous metal articles comprising dipping said ferrous metal articles in a bath containing the alloy according to claim 1 to improve drainage of the bath.

* * * * *